US005295667A

United States Patent [19]

Soofi

[11] Patent Number: 5,295,667

[45] Date of Patent: Mar. 22, 1994

[54] TUNDISH BAFFLE WITH FLUTED OPENINGS

[75] Inventor: Madjid Soofi, St. Charles, Ill.

[73] Assignee: Magneco/Metrel, Inc., Addison, Ill.

[21] Appl. No.: 97,650

[22] Filed: Jul. 26, 1993

[51] Int. Cl.[5] ..... C21C 5/48

[52] U.S. Cl. ..... 266/229; 75/407; 164/437; 266/230; 266/275

[58] Field of Search ..... 266/227, 229, 230, 275; 75/407; 164/337, 437

[56] References Cited

U.S. PATENT DOCUMENTS

| | | | |
|---|---|---|---|
| 2,503,621 | 9/1948 | Lindner et al. | 13/29 |
| 3,053,525 | 9/1962 | Leroy et al. | 266/34 |
| 3,380,727 | 4/1968 | Ruttiger et al. | 266/34 |
| 4,021,026 | 5/1977 | Szekely | 266/275 |
| 4,092,153 | 5/1978 | Yarwood et al. | 75/68 R |
| 4,277,281 | 7/1981 | Weber et al. | 75/93 R |
| 4,372,542 | 2/1983 | Chia | 266/229 |
| 4,385,931 | 5/1983 | Wallevik et al. | 75/67 A |
| 4,527,779 | 7/1985 | Roth et al. | 266/227 |
| 4,572,486 | 2/1986 | Groteke et al. | 266/229 |
| 4,619,443 | 10/1986 | Mitchell | 266/220 |
| 4,667,939 | 5/1987 | Luyckx | 266/287 |
| 5,064,175 | 11/1991 | Soofi | 266/229 |
| 5,071,107 | 12/1991 | Schmidt et al. | 266/230 |
| 5,083,753 | 1/1992 | Soofi | 266/229 |
| 5,083,754 | 1/1992 | Russo | 266/230 |

FOREIGN PATENT DOCUMENTS 86-303311/46 10/1986 Netherlands .

*Primary Examiner*—Melvyn J. Andrews

*Attorney, Agent, or Firm*—Willian Brinks Hofer Gilson & Lione

[57] ABSTRACT

A tundish baffle having a plurality of fluted openings is provided. The fluted openings interrupt and remove inclusions from molten metal passing through the baffle, using a plurality of obstructive peaks and valleys located at the perimeters of the openings. The fluted openings also include central portions which are not obstructed by the flutes, through which molten metal can flow in a regular fashion.

25 Claims, 3 Drawing Sheets

TUNDISH BAFFLE WITH FLUTED OPENINGS

FIELD OF THE INVENTION

The present invention relates to baffles for controlling the flow of fluids in vessels. More specifically, the invention is directed to baffles for controlling the flow of molten metal, and for helping to purify the molten metal, in metallurgical vessels such as tundish vessels used in the iron and steel industry.

BACKGROUND OF THE INVENTION

During the continuous casting of steel, for example, molten metal is transferred from large ladles into intermediate pouring vessels called tundishes. From these tundishes, the molten metal is poured into ingots, or other molds, to cast the molten metal.

While in the tundishes, impurities (called "inclusions") in the molten metal float to the top, forming a "slag" layer of impurities, and the pure, substantially "inclusion-free" metal exits from the bottom. Depending on the size of the tundish, and the flow rate of molten metal, the molten metal may not always have enough residence time in the tundish to permit the impurities to float to the top. To increase the residence time in tundishes, and regulate the flow of molten metal, baffles having flow control openings have been developed. One such baffle is disclosed in U.S. Pat. No. 4,667,939, issued to Luyckx.

Impurities entrained in the molten metal may affect the final cast product. Processing of the metal may be thereby hampered, or the finished product may be less pure, less structurally sound or have poor finishing quality. These impurities originate from several sources. For example, impurities may include metallic impurities such as alkaline and/or alkaline earth metals, dissolved entrained gases and occluded tundish surface oxide films which have broken up in the molten metal. In addition, inclusions may originate from non-metallic sources such as carbides or borides and eroded furnace and trough refractories. Effective removal of these impurities, with the aid of apertured baffles and other flow control devices, as appropriate, is an important aspect of molten metal processing.

As described in the above-referenced U.S. Pat. No. 4,667,939, tundish baffle openings or apertures are typically round. The apertures may be formed straight through the tundish baffle in a horizontal orientation, or may be slanted at an angle to direct the molten metal (and inclusions) somewhat upward. Also, the apertures may be cylindrical or frustoconical (i.e. tapered).

One of the problems existing in prior art apertured tundish baffles is that non-metallic inclusions tend to collect or "cake" around the outer circumferences of the round apertures. As this occurs, the baffle openings gradually become smaller until the flow of molten metal through the openings is blocked or choked off. Even when the round openings are only partially blocked, the functions of the apertured baffles are inhibited because the openings no longer control the residence time and flow of molten metal in the desired manner. Therefore, there is a need or desire in the iron and steel industry for apertured baffles which can accommodate the buildup of non-metallic inclusions in the apertures without seriously disrupting the residence time and flow control functions of the baffles.

SUMMARY OF THE INVENTION

The present invention is directed to an apertured tundish baffle whose openings, instead of being round, are fluted. Each opening includes a plurality of flutes arranged around the perimeter of the opening, and a central portion which does not include the flutes. The flutes are defined by an alternating sequence of peaks and valleys around the perimeter of the opening. The peaks partially obstruct, and reduce the flow of molten metal near the perimeter of each opening, but do not extend into, or obstruct the flow through, the central portion of each opening.

Impurities in the molten metal have an increased tendency to collect near the perimeters of the openings due to the reduced flow caused by the flutes. The impurities (primarily, non-metallic inclusions) settle, collect, and/or become trapped in the valleys, between the peaks, of the flutes. As the impurities collect and build up, the valleys gradually become filled, and the openings start to resemble more closely the round baffle openings of the prior art. However, throughout this process, the primary flow of molten metal through the central portions of the openings remains mostly unaffected.

When the flutes become filled, the baffle can be replaced before the buildup of inclusions becomes sufficient to impede flow through the central portions of the openings. The result is a cleaner molten metal product, due to the increased removal of inclusions by the flutes, and due to the improved flow control caused by less flow interruption through the central portions of the openings.

With the foregoing in mind, it is a feature and advantage of the invention to provide an apertured tundish baffle for a metallurgical vessel which accommodates a buildup of inclusions without significantly disrupting its intended functions of residence time and flow control.

It is also a feature and advantage of the invention to provide an apertured tundish baffle which directly aids in the purification of molten metal flowing through metallurgical vessels, by removing more impurities than prior art baffles.

It is also a feature and advantage of the invention to provide an apertured tundish baffle which includes a mechanism for preventing or delaying the time required for the openings to become obstructed or blocked due to the buildup of non-metallic inclusions.

It is also a feature and advantage of the invention to provide a tundish vessel which includes one or more tundish baffles of the invention.

The foregoing and other features and advantages of the invention will become further apparent from the following detailed description of the presently preferred embodiments, read in conjunction with the accompanying drawings. The detailed description and drawings are merely illustrative rather than limiting, the scope of the invention being defined by the appended claims and equivalents thereof.

DETAILED DESCRIPTION OF THE PRESENTLY PREFERRED EMBODIMENTS

Figure 1:
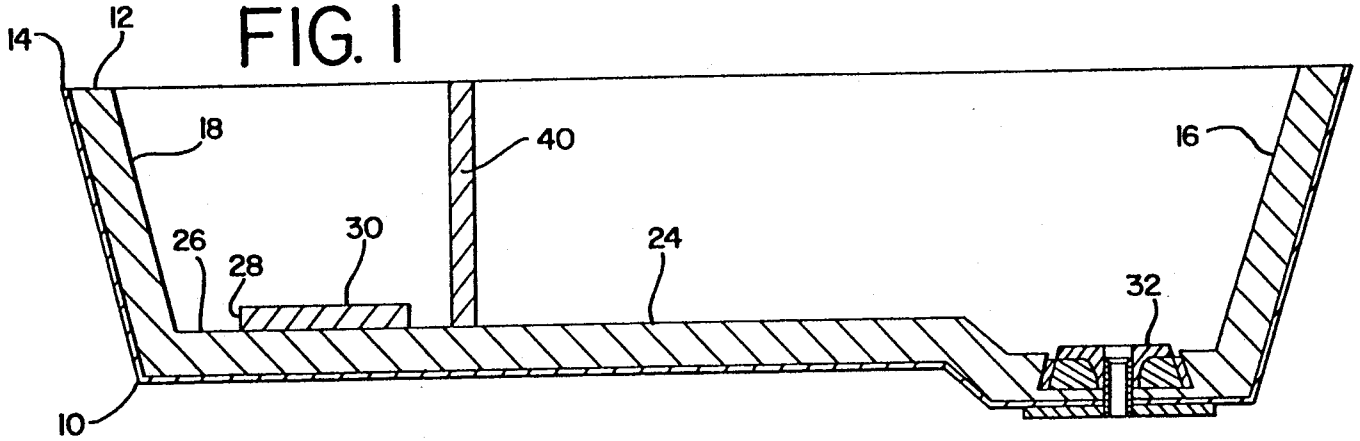
FIG. 1 is a side sectional view of a tundish vessel, having a baffle positioned upright adjacent to the region of impact.
Figure 2:
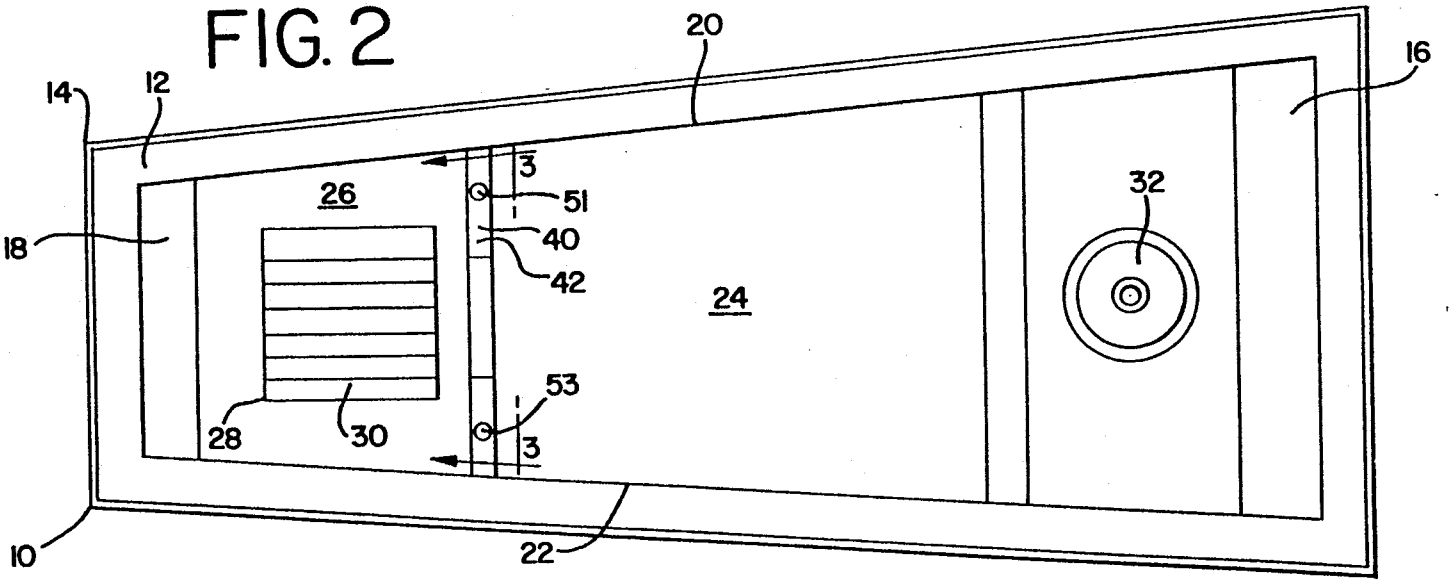
FIG. 2 is a top plan view of the tundish vessel shown in FIG. 1.

Referring to FIGS. 1 and 2, a tundish vessel, generally designated as 10, has an inner refractory lining 12 and an outer steel shell 14. The tundish vessel 10 has, on the inside, a front wall 16, a back wall 18, two side walls 20 and 22, and a floor 24. The floor 24 includes an impact region 26 for receiving molten iron or steel from a ladle, and a drain assembly 32, through which molten iron or steel exits the tundish vessel 10.

An impact pad 28 having a wavy upper surface 30 is located on the floor 24 in the region of impact 26, for reducing the vertical splashing and turbulence caused by the pouring of molten metal into the tundish vessel 10. An upright baffle 40 is mounted transversely across the tundish 10 between the sidewalls 20 and 22, for increasing the residence time and regulating the flow of molten metal from the impact region 26 toward the drain assembly 32. As presently contemplated, the baffle 40 has a tight press fit with the sidewalls 20 and 22, and is further fixed inside the tundish with a refractory cement binder.

Figure 3:
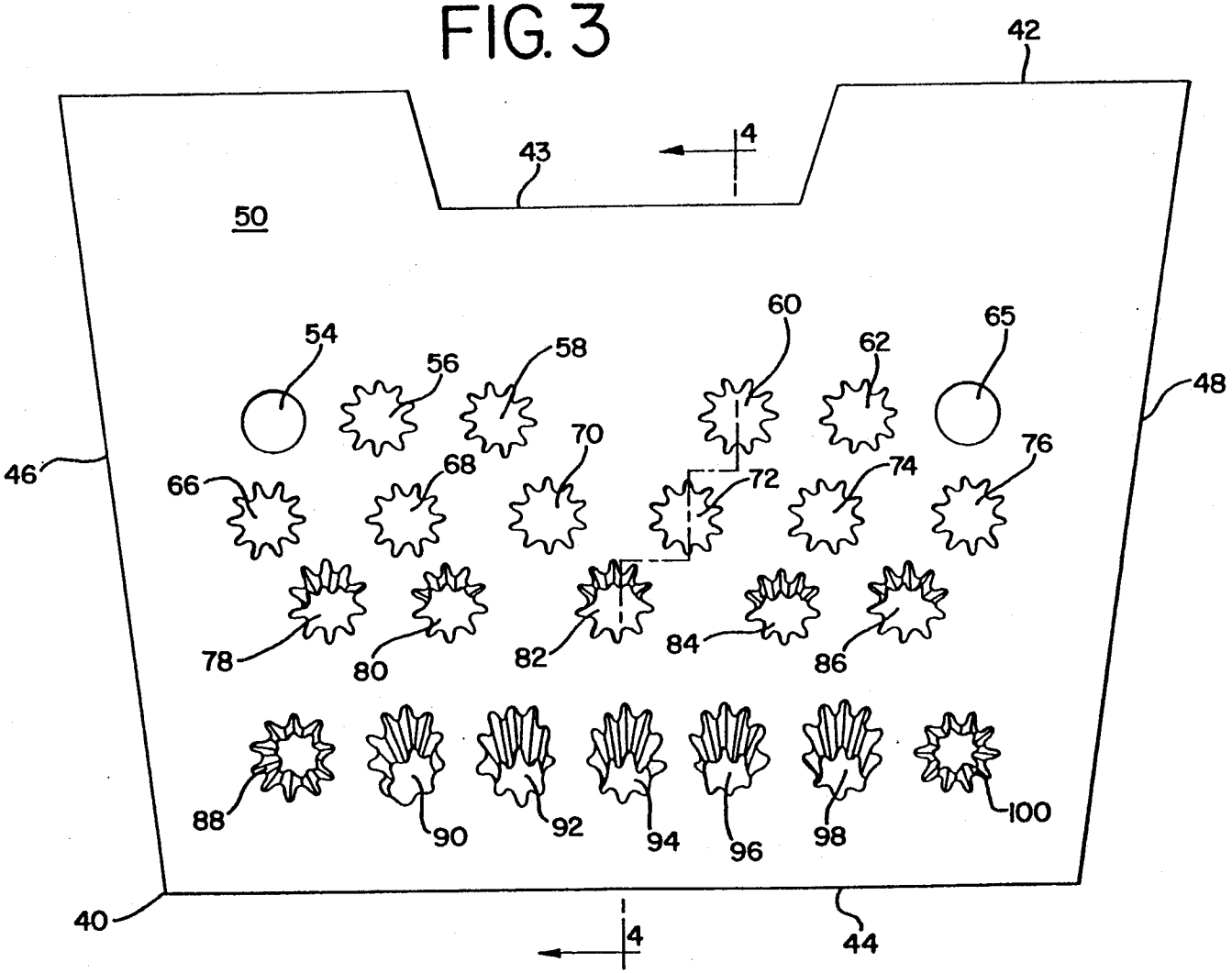
FIG. 3 is a front view of an apertured tundish baffle of the invention, taken along the line 3—3 in FIG. 2.
Figure 5:
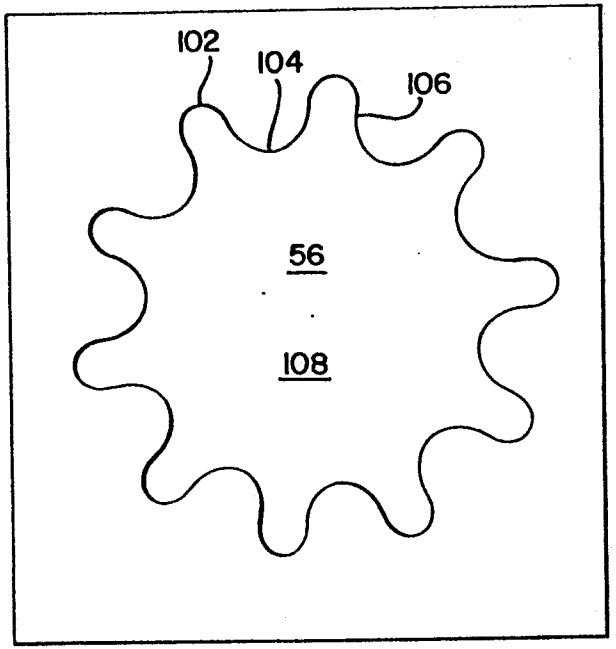
FIG. 5 is an exploded view of a single fluted opening in the apertured tundish baffle of the invention, before the flutes become filled with non-metallic inclusions.
Figure 4:
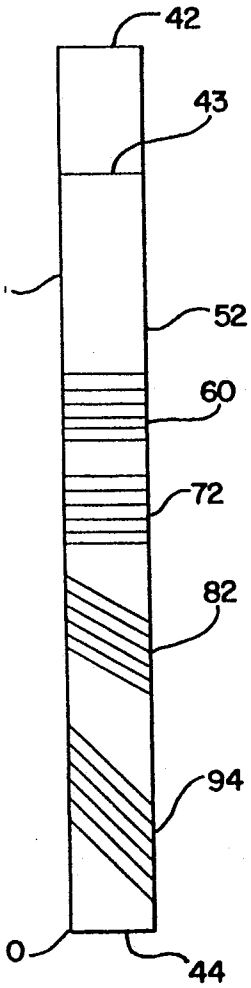
FIG. 4 is a side sectional view of an apertured tundish baffle of the invention, taken along the line 4—4 in FIG. 3.

Referring to FIGS. 2, 3 and 4, the tundish baffle 40 of the invention is preferably formed of a relatively thin refractory baffle plate having a top 42, a bottom 44, two side edges 46 and 48, a front surface 50 and a back surface 52. A plurality of aperture openings, designated in even numbers from 56-100 (excluding 64) extend through the baffle 40 from the front side 50 to the back side 52. As shown in FIG. 5, each of the baffle openings 56-100 has a plurality of flutes located completely around the outside perimeter 106, the flutes defined by a plurality of inward-projecting peaks 104 alternating with outward-projecting valleys 102. Each of the baffle openings 56-100 also has a central portion 108 which does not include the flutes. This means that the flutes, as defined by the peaks 104 and valleys 102, only cover the perimeter 106 of the openings 56-100, and do not extend to the centers of the openings.

Figure 6:
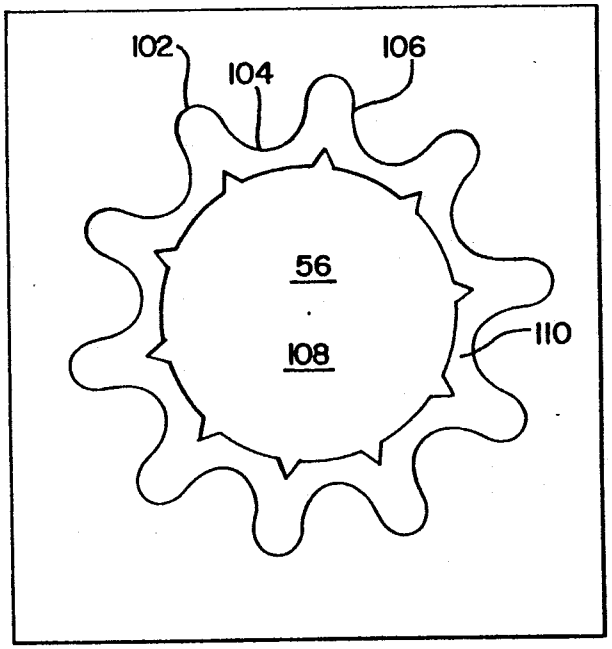
FIG. 6 illustrates the fluted opening of FIG. 5, after the flutes have become filled with inclusions.

During operation, molten metal flows through the fluted apertures 56-100 in the tundish baffle 40. The peaks 104 partially obstruct and slow down the flow of molten metal near the perimeter 106 of each of the openings 56-100. As a result, any inclusions (especially non-metallic inclusions) have greater tendencies to become lodged around the perimeter 106 of each of the openings 56-100, than if the openings were round. The inclusions gradually fill in the valleys 102 until the valleys 102 and peaks 104 are entirely covered by a continuous layer of inclusions 110 as shown in FIG. 6. At this time, the tundish baffle 40 should be replaced.

As shown in FIG. 6, even though the openings 56-100 may contain significant amounts of lodged or entrapped inclusions there is still relatively little obstruction of flow through the central portions 108 of the openings 56-100. Also, regardless of whether the openings 56-100 are completely free of inclusions as shown in FIG. 5 or nearing the end of their useful lives as shown in FIG. 6, most of the flow of molten metal passes through the central portions 108 where the velocity of molten metal is the greatest. Because the central portions 108 of the openings 56-100 remain mostly free of obstruction throughout the useful life of the baffle 40, the influence of the baffle 40 on the residence time and flow patterns of molten metal remains substantially uniform throughout the useful life of the baffle 40. Also, because inclusions easily become lodged in the valleys 102 between the peaks 104, the purity of molten metal leaving the tundish vessel 10 through the drain 32 is increased.

By comparison, baffle apertures of the prior art were generally round. This meant that any buildup of inclusions around the perimeters of the openings tended to obstruct flow through the openings, and the influence of the prior art baffles on residence time and flow patterns gradually changed as the buildup of inclusions became more severe.

When designing the tundish baffles of the invention, it is important that the fluted openings 56-100 be larger than corresponding round openings of prior art baffles, in order to accommodate the increased buildup of inclusions without permitting significant blockage of the central portions 108 of the fluted openings 56-100. As a starting point, the following design procedure is recommended. Referring to FIG. 5, the fluted opening 56 can be described as having an inner diameter defined as the diameter of an imaginary circle connecting the innermost ends of the peaks 104, and an outer diameter defined as the diameter of a second imaginary circle connecting the outermost ends of the valleys 102.

The inner diameter of the fluted opening, defined above, should be about the same as the diameter of the corresponding round opening in the prior art baffle being replaced. The outer diameter of the fluted opening, defined above, should be about 27% larger than the inner diameter. The number of "flutes" per opening, defined as the number of peaks 104 or the number of valleys 102, should be about one-half of the sum of a) the square of the inner diameter, in inches, and b) the square of the outer diameter, in inches.

For instance, if the prior art baffle being replaced had a particular round aperture with a diameter of 2.75 inches, then a corresponding fluted aperture in the baffle of the invention might have the following characteristics:

Inner diameter = 2.75 inches

Outer diameter = 2.75 (1.27) = 3.5 inches

Number of flutes = $\frac{1}{2}[(2.75)^2+(3.5)^2]=10$

The above optimization was made for a tundish baffle of the invention used for controlling the flow of molten steel through a typical tundish vessel as shown in FIGS. 1 and 2. The optimum design, and design procedure, may vary for different types of metal and/or different types of tundishes. The above optimization was for a baffle of the invention having a similar useful life as a corresponding prior art baffle. If a longer useful life is desired, the flutes can be made deeper by enlarging the outer diameter of the opening 56. If faster removal of inclusions is desired, the flutes can be made narrower by increasing the number of flutes.

Referring to FIGS. 2-4, the fluted openings 56-100 can be arranged in an optimum fashion for controlling the flow of molten metal, for example, molten steel, in the tundish. The baffle shown in FIG. 3 has a height of about 40.5 inches, a width of about 57 inches at the top and about 40.5 inches at the bottom, and a thickness of about 3.5 inches. The fluted openings are arranged in four rows, as shown.

The first row includes fluted openings 56, 58, 60 and 62. Each of these openings has an inner diameter of 2.75 inches, an outer diameter of 3.5 inches, and ten flutes around the perimeter. Fluted opening 56 is located, at its center, at a distance of 16.5 inches from the top 42 of the baffle 40 and 11.5 inches from the left side 46 of the baffle 40. Fluted opening 58 is 7 inches to the right of fluted opening 56 (center to center). Fluted opening 60 is 12 inches to the right of fluted opening 58. Fluted opening 62 is 7 inches to the right of fluted opening 60. Fluted openings 56, 58, 60 and 62 are neither tapered nor slanted from the horizontal (see FIG. 4).

The second row includes fluted openings 66, 68, 70, 72, 74 and 76. Fluted opening 66 is located, at its center, at a distance of 21.5 inches from the top 42 and 6 inches from the left side 46 of the baffle 40. Fluted opening 68 is 8.25 inches to the right of opening 66 (center to center). Fluted opening 70 is 6.5 inches to the right of opening 68. Fluted opening 72 is 7 inches to the right of opening 70. Fluted opening 74 is 6.5 inches to the right of opening 72. Fluted opening 76 is 8.25 inches to the right of opening 74. Each of these openings has an inner diameter of 2.75 inches, an outer diameter of 3.5 inches, and ten flutes around the perimeter. These fluted openings are neither tapered nor slanted from the horizontal (see FIG. 4), but are perpendicular to the baffle plate 40.

The third row includes fluted openings 78, 80, 82, 84 and 86. Fluted opening 78 is located 28.5 inches from the top 42 and 9.5 inches from the left side 46 of the baffle 40. Fluted opening 80 is 5.5 inches to the right of opening 78. Fluted opening 82 is 9 inches to the right of opening 80. Fluted opening 84 is 9 inches to the right of opening 82. Fluted opening 86 is 5.5 inches to the right of opening 80. Each of these openings has an inner diameter of 2.75 inches, an outer diameter of 3.5 inches, and ten flutes around the perimeter. These openings are each slanted at an angle of 35 degrees from a horizontal line perpendicular to the baffle plate (see FIG. 4). The purpose of the slanting, with reference to FIG. 1, is to cause molten metal near the bottom of the tundish 10 to flow in an upward trajectory path between the region of impact 26 and the drain 32, after leaving the baffle 40. Inclusions which remain entrained in the molten metal after passing the baffle 40 are thereby forced upward, toward the slag layer at the top of the vessel 10, instead of downward toward the drain 32.

The fourth row includes fluted openings 88, 90, 92, 94, 96, 98 and 100. Fluted opening 88 is located 37 inches from the top 42 and 7.5 inches from the left side 46 of the tundish baffle 40. Fluted opening 90 is 5.5 inches to the right of opening 88. Fluted opening 92 is 5.5 inches to the right of opening 90. Fluted opening 94 is 5.5 inches to the right of opening 92. Fluted opening 96 is 5.5 inches to the right of opening 94. Fluted opening 98 is 5.5 inches to the right of opening 96. Fluted opening 100 is 7.5 inches to the right of opening 98. Each of these openings has an inner diameter of 2.75 inches, an outer diameter of 3.5 inches, and ten flutes around the perimeter. Openings 90, 92, 94, 96 and 98 are each slanted at an angle of 45 degrees from a horizontal line perpendicular to the baffle plate (see FIG. 4), for the reasons stated above. Openings 88 and 100 are not slanted from the horizontal, but can be somewhat tapered (see FIG. 3). Openings 88 and 100 serve as baffle drains.

Referring to FIG. 3, a depressed portion 43 is formed in the top 42 of the baffle 40. The depressed portion 43 provides an upper passage over the baffle 40 for any slag which might accumulate in the pouring region 26 of the vessel 10, and for any overflow of molten metal. Referring to FIGS. 2 and 3, two passages 51 and 53 extend vertically downward from the top 42 of the baffle 40 and end at the location of porous media 54 and 55, for example, porous plugs of refractory material. An inert gas such as argon can be injected into the molten metal via the inlet passages 51 and 53, and through porous media 54 and 55. Injection of the gas, in the form of small bubbles, helps lift the less dense non-metallic inclusion and gaseous inclusions to the top of the molten metal, to be absorbed by the slag and removed by skimming the metal surface.

The baffle 40 is made from a fired refractory material. A ceramic refractory material made from aluminum oxide, fired at about 2300° F. (1260° C.) has been found advantageous. Other suitable high temperature-resistant refractory materials known in the iron and steel industry can also be used. The baffle 40 can be formed using a mold, or any other commonly known refractory forming process.

While the foregoing embodiments of the invention are presently considered to be preferred, various changes and modifications can be made without departing from the spirit and scope of the invention. The scope of the invention is indicated in the appended claims, and all changes that fall within the meaning and range of equivalency of the claims are intended to be embraced therein.

I claim:

1. A baffle for directing the flow of molten metal in a metallurigcal vessel, comprising:

a baffle plate; and a plurality of fluted openings passing through the plate;

each of the fluted openings including a perimeter, a center portion, and a plurality of flutes around the perimeter;

the flutes being defined by peaks and valleys around the perimeter;

the peaks not extending into the center portion.

2. The baffle of claim 1, wherein the flutes are defined by an alternating sequence of peaks and valleys.

3. The baffle of claim 1, wherein the flutes are located completely around the perimeter.

4. The baffle of claim 1, wherein at least some of the fluted openings are arranged in a row.

5. The baffle of claim 1, wherein at least some of the fluted openings are perpendicular to the baffle plate.

6. The baffle of claim 1, wherein at least some of the fluted openings are slanted at an angle from a line perpendicular to the baffle plate.

7. The baffle of claim 6, wherein the angle is about 35 degrees.

8. The baffle of claim 6, wherein the angle is about 45 degrees.

9. The baffle of claim 4, comprising a plurality of rows of fluted openings.

10. The baffle of claim 4, comprising four rows of fluted openings.

11. The baffle of claim 1, wherein at least some of the fluted openings have an inner diameter of about 2.75 inches.

12. The baffle of claim 1, wherein at least some of the fluted openings have an outer diameter of about 3.5 inches.

13. The baffle of claim 1, further comprising one or more porous media through which gas can be injected.

14. A baffle for directing the flow of fluid, comprising:

a baffle plate having a top, a bottom, two side edges, a front surface and a back surface; and a plurality of openings passing through the baffle plate from the front surface to the back surface;

each of the openings including a perimeter, a center portion, and a plurality of flutes around the perimeter.

15. The baffle of claim 14, wherein the flutes are defined by peaks and valleys around the perimeter.

16. The baffle of claim 15, wherein the flutes are arranged in rows.

17. The baffle of claim 16, comprising a row which includes four fluted openings.

18. The baffle of claim 16, comprising a row which includes five fluted openings.

19. The baffle of claim 16, comprising a row which includes six fluted openings.

20. The baffle of claim 16, comprising a row which includes seven fluted openings.

21. The baffle of claim 16, comprising a row which includes less than five fluted openings.

22. In a tundish vessel which includes a front wall, a back wall, two side walls, an impact region and a drain, the improvement comprising:

an upright baffle mounted in the tundish vessel between the two side walls;

the baffle including a plurality of fluted openings for directing the flow of molten metal in the tundish vessel.

23. The tundish vessel of claim 22, wherein the baffle is mounted transversely across the tundish vessel.

24. The tundish vessel of claim 22, wherein each of the fluted openings comprises a perimeter defined by alternating peaks and valleys.

25. The tundish vessel of claim 22, wherein each of the fluted openings comprises a central portion not obstructed by the flutes.

* * * * *

UNITED STATES PATENT AND TRADEMARK OFFICE

CERTIFICATE OF CORRECTION

PATENT NO. : 5,295,667

DATED : March 22, 1994

INVENTOR(S) : Madjid Soofi

It is certified that error appears in the above-indentified patent and that said Letters Patent is hereby corrected as shown below:

Column 6, line 36:

In Claim 1, line 2 delete "metallurigcal" and insert --metallurgical--.

Signed and Sealed this

Twenty-fifth Day of October, 1994

*Attest:*

*Attesting Officer*

Bruce Lehman

BRUCE LEHMAN

*Commissioner of Patents and Trademarks*